US012378672B2

(12) United States Patent
Goradia

(10) Patent No.: US 12,378,672 B2
(45) Date of Patent: Aug. 5, 2025

(54) METHODOLOGY FOR COATING NON-CONDUCTING ARTICLES WITH BROAD-SPECTRUM ANTIMICROBIAL ELECTROLESS PLATING LAYERS

(71) Applicant: Prerna Goradia, Mumbai (IN)

(72) Inventor: Prerna Goradia, Mumbai (IN)

( * ) Notice: Subject to any disclaimer, the term of this patent is extended or adjusted under 35 U.S.C. 154(b) by 0 days.

(21) Appl. No.: 17/740,280

(22) Filed: May 9, 2022

(65) Prior Publication Data

US 2022/0356582 A1 Nov. 10, 2022

(30) Foreign Application Priority Data

May 9, 2021 (IN) ..... 202121020981

(51) Int. Cl.
*C23C 18/40* (2006.01)
*C23C 18/16* (2006.01)

(52) U.S. Cl.
CPC ..... *C23C 18/405* (2013.01); *C23C 18/1639* (2013.01); *C23C 18/166* (2013.01)

(58) Field of Classification Search
CPC . C23C 18/405; C23C 18/1639; C23C 18/166; C23C 18/1641; C23C 18/1851; C23C 18/1872; C23C 18/1886; C23C 18/1893; C23C 18/20; C23C 18/2073; C23C 18/2086
See application file for complete search history.

(56) References Cited

U.S. PATENT DOCUMENTS 4,004,051 A * 1/1977 Kadison ..... C23C 18/28 106/287.18
4,239,813 A * 12/1980 Murakami ..... H05K 3/185 427/98.5
4,261,800 A * 4/1981 Beckenbaugh ..... H05K 3/185 205/187
2008/0138624 A1* 6/2008 Lewis ..... C23C 28/322 428/469
2009/0297802 A1* 12/2009 Sastry ..... C23C 18/165 428/209
2010/0215974 A1* 8/2010 Tacken ..... C23C 18/1639 427/372.2
2019/0345612 A1* 11/2019 Tanabe ..... C23C 18/44
2021/0164105 A1* 6/2021 Nakhmanovich ..... C09D 11/38

FOREIGN PATENT DOCUMENTS

WO WO-9948682 A1 * 9/1999 ..... B05D 1/185

* cited by examiner

*Primary Examiner* — Dah-Wei D. Yuan
*Assistant Examiner* — Nga Leung V Law
(74) *Attorney, Agent, or Firm* — Alley IP

(57) ABSTRACT

A method of coating an antimicrobial conductive metal layer on a non-conductive surface of articles with novel chemistry and methods with just a few process steps consisting of contacting the chemistries at room temperature for short durations is disclosed. The methodology is environmentally friendly, non-toxic aqueous bath of different salt compositions for providing uniform anti-microbial metal coating on the articles. The cost-effective methodology can be used on a wide variety of non-conductive surfaces such as glass, fibers, textiles, ceramic, plastic, foam and so on.

19 Claims, 4 Drawing Sheets

METHODOLOGY FOR COATING NON-CONDUCTING ARTICLES WITH BROAD-SPECTRUM ANTIMICROBIAL ELECTROLESS PLATING LAYERS

RELATED APPLICATIONS

This application claims priority under 35 U.S.C. § 119 to co-pending IN Application 202121020981, filed May 9, 2021. This IN Application and PCT Application PCT/IN2022/050090 filed Feb. 3, 2022 are incorporated by reference herein in their entireties.

BACKGROUND

Electroless plating, also known as chemical plating, is a way of plating the non-conductive surfaces/articles without using an external power source. It is an industrial chemical process that creates metal coatings on various materials by autocatalytic chemical reduction of metal cations in a liquid bath. The surface produced as a result of electroless plating tends to be less porous, thereby more resistant to corrosion.

Palladium is mostly used as a catalyst in various conventional methods for the subsequent electroless deposition of metals such as copper or gold, but palladium is quite an expensive metal, where the price of the metal exceeds the price of gold at times by several times. Though other less expensive metals or chemicals have also been suggested as the catalyst, such as silver or tin. However, there have been problems associated with the use of silver in that it may not provide sufficient catalytic strength, or there is a drawback in that it causes problems such as poor deposition of the subsequently applied electroless metal; due to which silver alone has not been a favored methodology. Considering these factors, there is need of a cost effective and non-toxic methodology which can effectively coat the non-conducting surfaces with broad spectrum antimicrobial electroless plating layers.

References have been made to the following literature:

EP1453988 relates to a method of forming a conductive metal layer on a non-conductive surface, including providing a non-conductive surface; contacting the non-conductive surface with an aqueous solution or mixture containing a stannous salt to form a sensitized surface; contacting the sensitized surface with an aqueous solution or mixture containing a silver salt; and electroless plating the catalyzed surface by applying an electroless plating solution to the catalyzed surface.

U.S. Pat. No. 3,932,694 relates to a pre-treatment method for electroless plating of metal film resistors, where a stabilized and uniform activating film is formed on the base material to be plated by sequential treatment of said base material with a stannous chloride (SnCl2) solution, a silver salt solution, a second stannous chloride solution and a palladium, a palladium chloride (PdCl2) solution.

US20160319452 relates to a novel composition and method comprising of potassium permanganate having superior properties to aluminum anodized by the conventional method with respect to durability and corrosion resistance. In addition to anodizing, the novel solution described herein is capable of several other uses including the removal of organic and metal contaminants from solution, producing black electroless nickel on a substrate, producing a bright nickel coating on a substrate such as aluminum, and cleaning and activating aluminum for plating. Again, it is not related to the inventive steps described in the current methods.

JP2008013845 relates to an electroless aluminum plating bath for electroless plating of aluminum, comprising a room temperature molten salt containing aluminum and a reducing agent for plating aluminum.

This background provides a useful baseline or starting point from which to better understand some example embodiments discussed below. Except for any clearly-identified third-party subject matter, likely separately submitted, this Background and any figures are by the Inventor(s), created for purposes of this application. Nothing in this application is necessarily known or represented as prior art.

SUMMARY

Example embodiments overcome the problems faced in the prior art and disclose a method of coating an antimicrobial conductive metal layer on a non-conductive surface of articles. The antimicrobial coating effectively neutralizes microorganisms while not altering the characteristics of the articles.

Example embodiments include baths, processes and systems for electroless plating of the articles for producing smooth and adherent deposits of antimicrobial coating on the non-conducting surface of various substances, not limited to ceramics, glass, and plastics.

Example methods include electroless metallization of non-conductive substrates, comprising the steps of: a) providing a non-conductive article; b) dipping the article in a reducing bath, wherein the bath comprises reducing agents 1-5 by wt %, pH maintaining buffer 0-1 by wt %, in water for 1-3 minutes; c) water rinsing the articles; d) activating the rinsed article by immersing in an aqueous activating bath/dip, wherein the aqueous bath comprises simple complexes of transition metals 0.1-5 by wt %, chelating agents 1-10 by wt % and pH maintaining agents in water for 1-3 minutes, wherein the activating bath provides thin film coating on the article; e) water rinsing the articles in a bath or flowing water; and f) air drying the coated article.

Example embodiments further include a method wherein the non-conductive article is selected from a group comprising plastic, polymer, ceramic, composite material articles, plastics, fabric, natural fibers and combinations thereof.

Example embodiments further include a method wherein the reducing agent in the reducing bath is selected from a group comprising hypophosphites, formaldehyde, ascorbic acid, stannous chloride and combinations thereof. Further, the article is dipped in the reducing bath for 1-3 minutes at room temperature, wherein the reducing agent in the reducing bath is absorbed on the surface providing base for next activating bath step. The salt selected from a group of $SnCl_2$ and other reducing salts such as Fe(II) ions, can be oxidized to Fe(III) ions, Mn(II) ions which can get oxidized to Mn(VII) ions and Ce(III) to Ce(IV), and such redox couples can be used in the sensitization step.

Example embodiments further include a method wherein the transition metals in the activating bath are selected from a group comprising, notably silver, gold, copper, platinum, iridium, palladium, rhodium, ruthenium, technetium, molybdenum, niobium, zirconium, yttrium and combinations thereof. The chelating agent in the activating bath is selected from a group comprising EDTA (ethylenediaminetetraacetic acid), NTA (nitrilotriacetic acid), DTPA (diethylene-triaminepentaacetic acid), DS (N-(1,2-dicarboxyethyl)-D,L-aspartic acid (iminodisuccinic acid), DS (polyaspartic acid), EDDS (N,N'-ethylenediaminedisuccinic acid), GLDA (N,N-bis(carboxylmethyl)-L-glutamic acid)

and MGDA (methylglycinediacetic acid) and combinations thereof. Further, the activating solution could be acidic or basic with pH in a range of 3-9, wherein the activating dip forms nucleating sites on the article, transforming into thin film depending upon the time of immersion, with coating thickness in range 1-10 microns.

Example embodiments include a method wherein the activated article is treated for an additional antimicrobial coating with antimicrobial metal by dipping it in antimicrobial bath for 5-10 minutes to homogeneously cover the entire article and/or dipping it in a solution of self-assembled monolayer molecule such as alkanethiols to impart an anti-tarnish ability and combinations thereof. Further, the additional antimicrobial coating bath comprises complexed and stabilized 1-50 g/liter CuSO4, 0.1-5 formaldehyde by wt % water, with pH of the additional antimicrobial bath in the range of 8-10 and thickness of the coating in additional antimicrobial coating bath between 1-100 microns. The metal in additional antimicrobial coating bath is selected from a group comprising silver, zinc, copper, gold and combinations thereof but not limited to. Further, the treatment in antimicrobial coating bath is for 1-15 minutes depending upon the thickness of the anti-microbial coating required for the composites. Besides, the rinsing steps are carried out between each of the individual treatment steps and the rinse water may be distilled water, but tap water is also applicable, with the temperature of the rinse water between room temperature to about 30° C.

Example embodiments include a method wherein drying is by air drying or in a stream of hot air. Further, the coatings in the pretreatment and metallization steps are performed by dipping, spraying, rolling, brushing, dripping, pouring, curtain coating, and combinations thereof but not limited to.

Example embodiments include a method wherein an additional etching step may be added as pretreatment step for coating the hard materials selected from a group of ceramic, glass and engineering plastic composites. Further, mild HF, NH4F and other fluorine containing etchants may be added in the etching baths for glassy and ceramic type of substrates.

Example embodiments include a cost-efficient process and since there is no need for hexavalent chrome type of materials the disinfectant is less-hazardous, so wastewater generated is also non-toxic to the environment. The room-temperature method for electroless metallization of non-conductive substrates is pure surface dependent chemistry and free of any pretreatment preparation or surface conditioning.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTIONS OF THE DRAWINGS

Example embodiments will become more apparent by describing, in detail, the attached drawings, wherein similar elements are represented by similar reference numerals. The drawings serve purposes of illustration only and thus do not limit example embodiments herein. Elements in these drawings may be to scale with one another and exactly depict shapes, positions, operations, and/or wording of example embodiments, or some or all elements may be out of scale or embellished to show alternative proportions and details.

DETAILED DESCRIPTION

Figure 1:
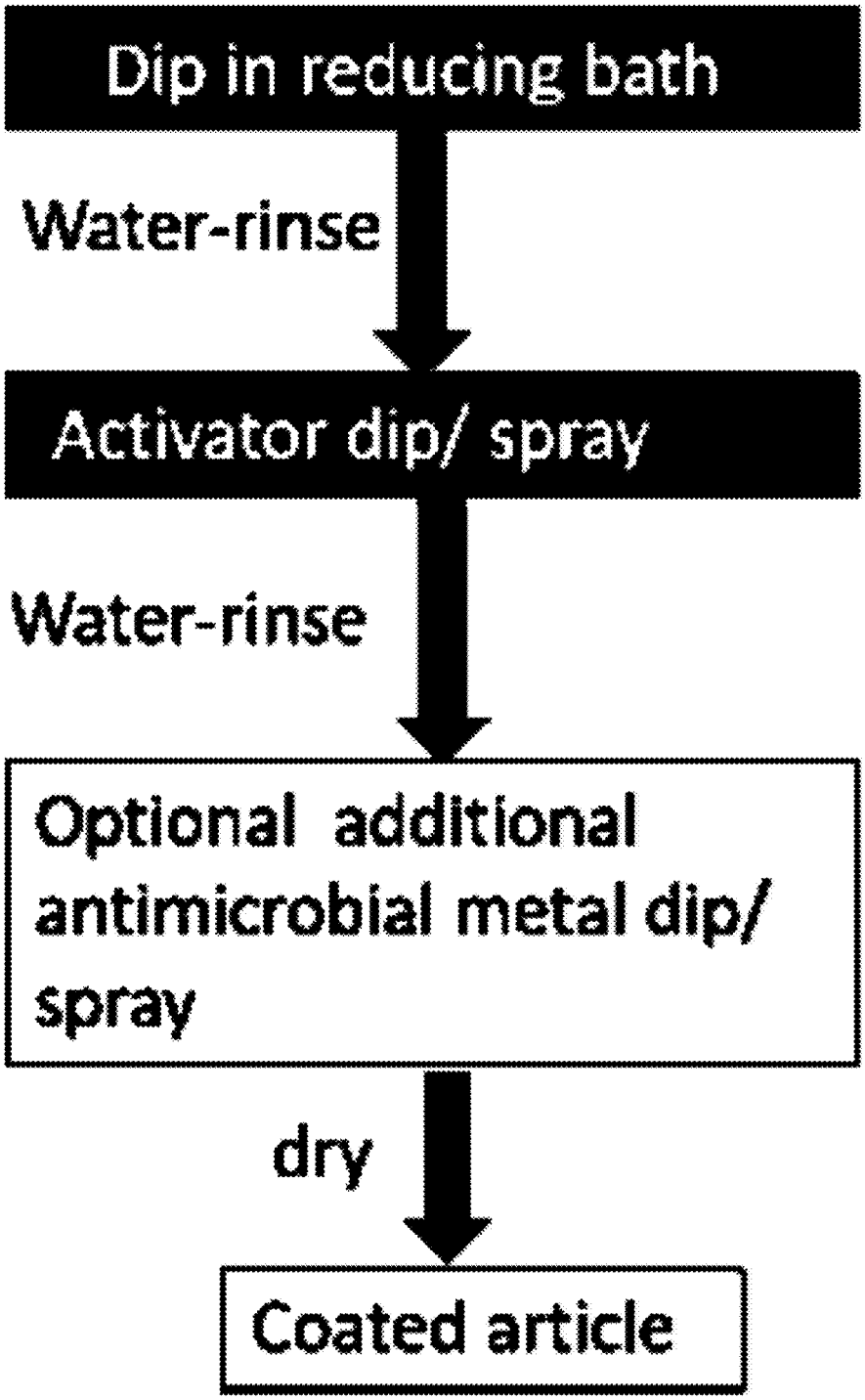
FIG. 1 illustrates the schematic representation of the electroless coating of composites by scheme 1.

Because this is a patent document, general broad rules of construction should be applied when reading it. Everything described and shown in this document is an example of subject matter falling within the scope of the claims, appended below. Any specific structural and functional details disclosed herein are merely for purposes of describing how to make and use examples. Several different embodiments and methods not specifically disclosed herein may fall within the claim scope; as such, the claims may be embodied in many alternate forms and should not be construed as limited to only examples set forth herein.

Membership terms like "comprises," "includes," "has," or "with" reflect the presence of stated features, characteristics, steps, operations, elements, and/or components, but do not themselves preclude the presence or addition of one or more other features, characteristics, steps, operations, elements, components, and/or groups thereof. Rather, exclusive modifiers like "only" or "singular" may preclude presence or addition of other subject matter in modified terms. The use of permissive terms like "may" or "can" reflect optionality such that modified terms are not necessarily present, but absence of permissive terms does not reflect compulsion. In listing items in example embodiments, conjunctions and inclusive terms like "and," "with," and "or" include all combinations of one or more of the listed items without exclusion. The use of "etc." is defined as "et cetera" and indicates the inclusion of all other elements belonging to the same group of the preceding items, in any "and/or" combination(s). Modifiers "first," "second," "another," etc. may be used herein to describe various items, but they do not confine modified items to any order. These terms are used only to distinguish one element from another; where there are "second" or higher ordinals, there merely must be that many number of elements, without necessarily any difference or other relationship among those elements.

When an element is related, such as by being "connected," "coupled," "on," "attached," "fixed," etc., to another element, it can be directly connected to the other element, or intervening elements may be present. In contrast, when an element is referred to as being "directly connected," "directly coupled," etc. to another element, there are no intervening elements present. Other words used to describe the relationship between elements should be interpreted in a like fashion (e.g., "between" versus "directly between," "adjacent" versus "directly adjacent," etc.).

As used herein, singular forms like "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to the same previously-introduced term. Relative terms such as "almost" or "more" and terms of degree such as "approximately" or "substantially" reflect 10% variance in modified values or, where understood by the skilled artisan in the technological context, the full range of imprecision that still achieves functionality of modified terms. Precision and non-variance are expressed by contrary terms like "exactly."

The structures and operations discussed below may occur out of the order described and/or noted in the figures. For example, two operations and/or figures shown in succession may in fact be executed concurrently or may be executed in the reverse order, depending upon the functionality/acts involved. Similarly, individual operations within example methods described below may be executed repetitively, individually or sequentially, so as to provide looping or other series of operations aside from exact operations described below. It should be presumed that any embodiment or method having features and functionality described below, in any workable combination, falls within the scope of example embodiments.

The inventor has recognized that despite the widespread use of stannous chloride solution and palladium chloride solution for the treatments of the non-conducting surfaces for electroless plating, palladium only coating is a costly process and the multi-step process produces waste conducting solution, in turn polluting the environment. Thus, a need remains for a novel methodology in such applications which besides environmentally friendly is both economical as well as provide excellent electroless plating results on the non-conductive surface of interest, with broad spectrum antimicrobial properties.

The present invention is electroless plating and systems using the same. In contrast to the present invention, the few example embodiments and example methods discussed below illustrate just a subset of the variety of different configurations that can be used as and/or in connection with the present invention.

Example embodiments include baths, processes and systems for electroless plating of the articles for producing smooth and adherent deposits of antimicrobial coating on the non-conducting surface of various substances. Example methods may form an antimicrobial conductive metal layer on a non-conductive surface of articles. Electroless plating methods improve the performance of the component by providing a metallic layer on to the surface, where the plastic/glass/ceramic surfaces may be etched first as an optional step.

Figure 4:
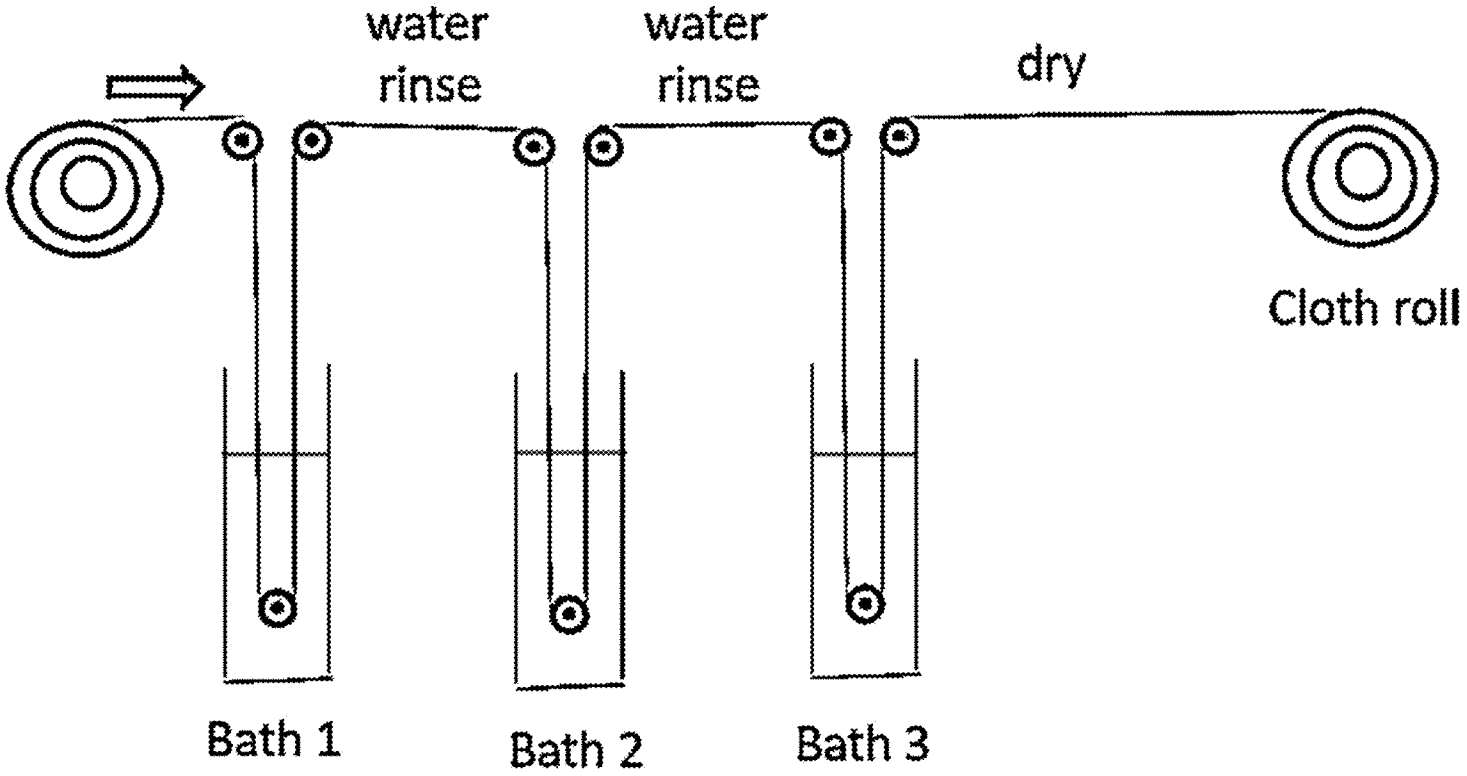
FIG. 4 illustrates the antimicrobial coating scheme in padding process.

Reference may be made to FIG. 1 illustrating the schematic representation of the Electroless coating of composites by scheme 1. The two preferred schemes for the deposition of the antimicrobial layers are described in FIGS. 1 and 2 as scheme 1 and 2. In scheme 1 the object is dipped or sprayed or rolled into (as shown in FIG. 4) a reducing bath. Post this step, the object is then put in the metal bath containing a noble metal salt preferably, resulting in a beautiful covering of silver obtained for instance.

Figure 2:
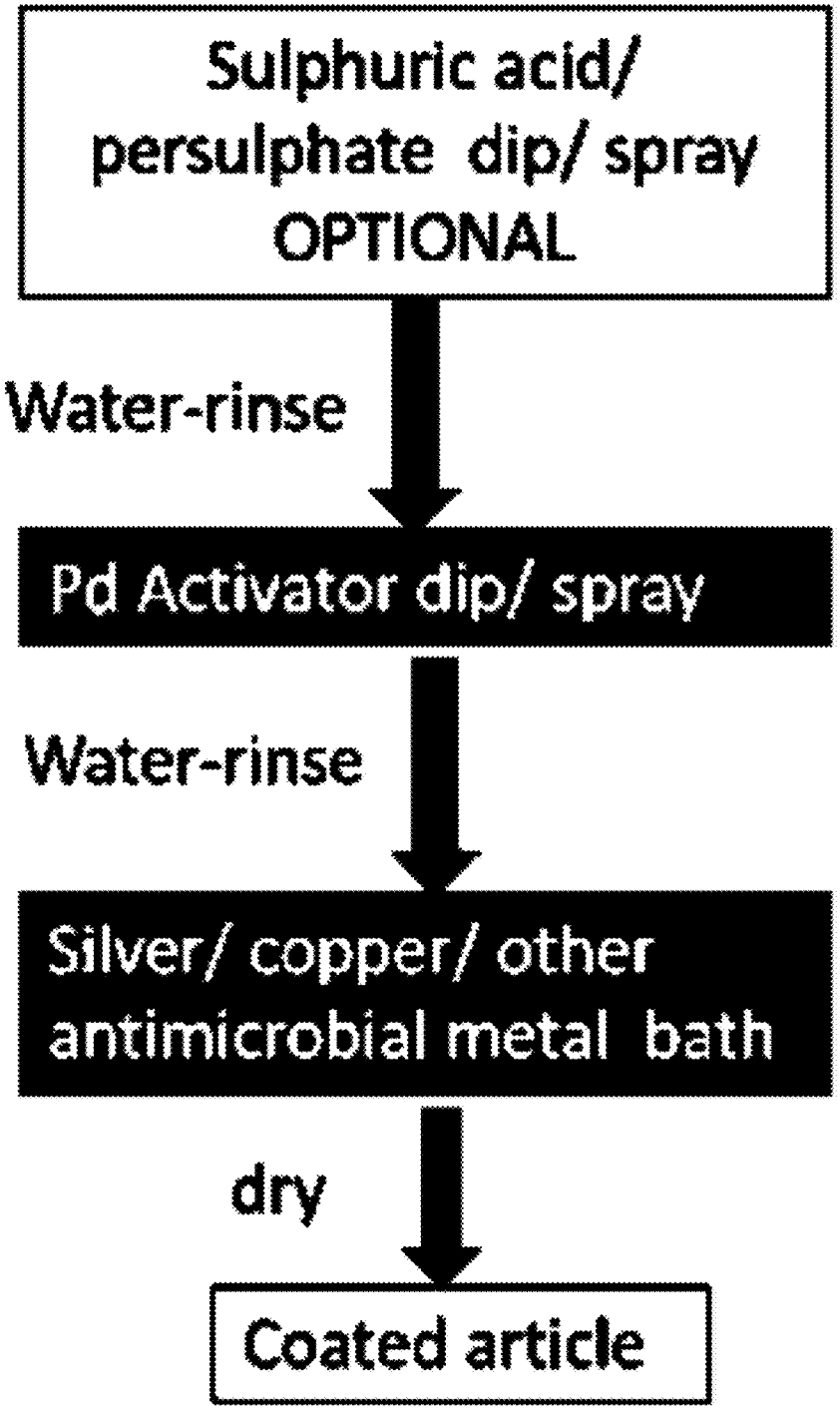
FIG. 2 illustrates the schematic representation of the electroless coating of composites by scheme 2.

Reference may be made to FIG. 2 illustrating the schematic representation of the electroless coating of composites by scheme 2. In the second scheme, a combined activator bath and copper bath are used as the essential steps and a continuous conducting layer of copper is obtained. The object is dipped in the catalyst bath and then the catalyzed surface by applying an electroless plating solution to the catalyzed surface in an electroplating bath comprising of one or a mixture of two or more selected from formaldehyde-copper sulphate system, sulphuric acid, hydrofluoric acid, phosphoric acid, acetic acid, The copper ions are in a complexed state using an ethylene diamine and propylene oxide-based polyether polyol tetrol. The combined activator catalytic system allows the combination of the sensitization and the activation steps by immersion of the substrates in a single bath (one step catalyst). It's a dark liquid containing a high concentration of HCl, in which various amounts of SnCl2 and other activators are dissolved, Adsorption of colloidal metal centers on the substrates provide the catalytic sites for the reduction of the copper in metal in the next step.

Figure 3:
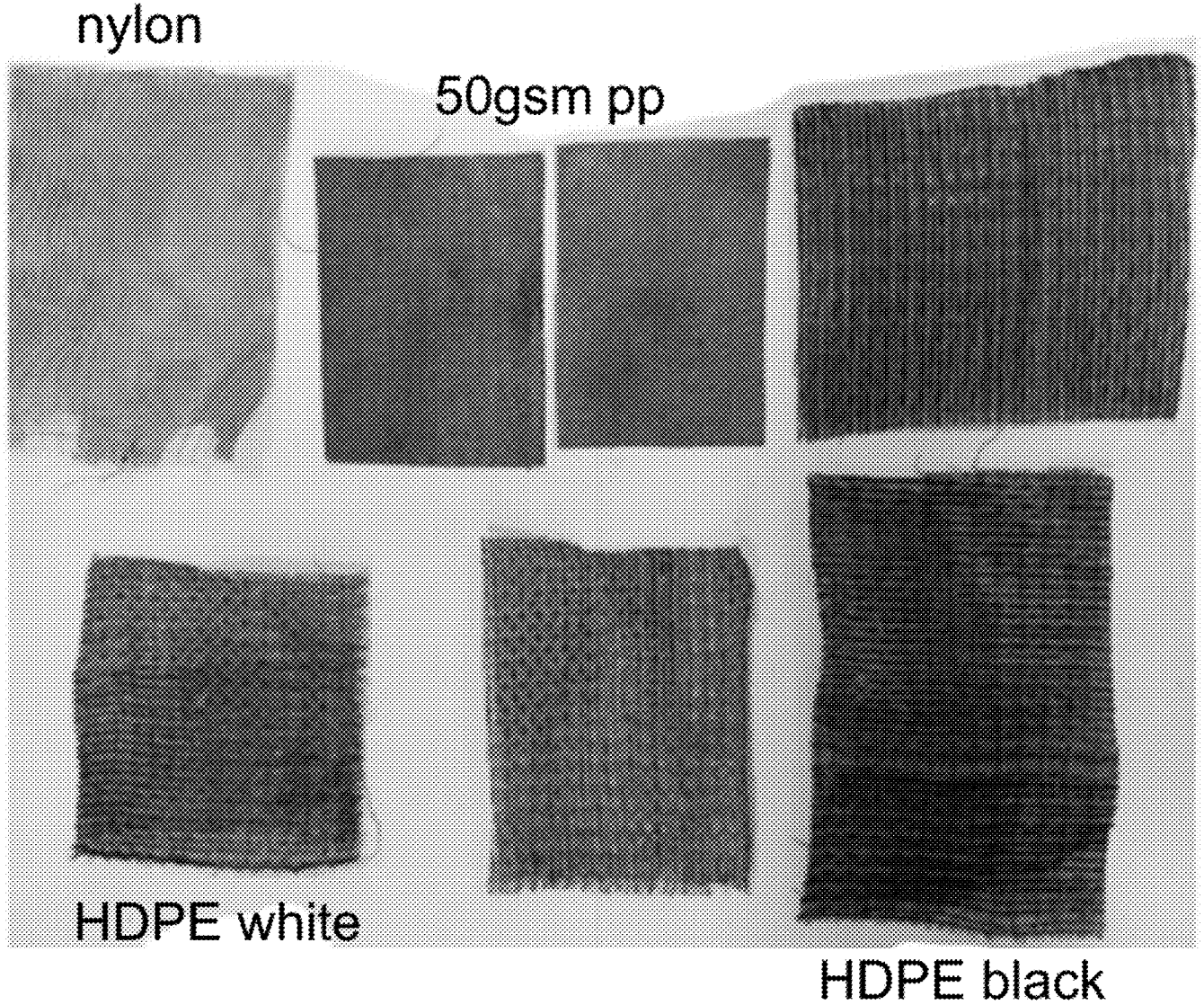
FIG. 3 illustrates the various impregnated non-woven fabrics for few minutes each in the 3 baths at room temperature.

Reference may be made to FIG. 3 illustrating the various impregnated non-woven fabrics for ≤few minutes each in the 3 baths at room temperature; the different types of coated antimicrobial cloths—nylon, PP, HDPE are shown here where uniform and effective antimicrobial coating was observed.

Reference may be made to FIG. 4 illustrating the antimicrobial coating in padding process. In this the traditional padding process for textiles has been adapted to coat textiles, non-woven fabrics and sheets of plastic type industrially relevant materials with antimicrobial layers. In padding process, fabric is passed between rollers to pass through the troughs containing the liquid or chemical to be applied. After passing through the pad trough, the fabric is squeezed by the pad rollers to remove the excess solution and the fabric is guided onto the pin clips on the tenter frame. The tenter frame oven or dry can accomplishes both the drying and the curing function. After exiting the oven, the fabric is batched on a roll-up device. It may also go through a stenter where the stenter brings the length and width to pre-determined dimensions and also maintains the heat treatment. The padding system application can therefore be thought to be composed of three stages a) pad bath preparation b) the actual padding process and c) the drying and curing step.

In an example embodiment a novel methodology for electroless metallization of non-conductive substrates, comprises the steps of: a) providing a non-conductive article; b) dipping the article in a reducing bath, wherein the bath comprises reducing agents 1-5 by wt %, pH maintaining buffer 0-1 by wt %, in aqueous solvents for 1-3 minutes; c) water rinsing the articles; d) activating the rinsed article by immersing in an aqueous activating bath/dip, wherein the aqueous bath comprises simple complexes of transition metals 0.1-5 by wt %, chelating agents 1-10 by wt % and pH maintaining agents in aqueous solvent for 1-3 minutes, wherein the activating bath provides thin film coating on the article; e) water rinsing the articles in a bath or flowing water; and f) air drying the coated article.

In another example embodiment a method uses the non-conductive article selected from a group comprising plastic, polymer, ceramic, composite material articles, plastics, fabric, natural fibers and combinations thereof.

In another example embodiment a method uses the reducing agent in the reducing bath selected from a group comprising hypophosphites, formaldehyde, ascorbic acid, stannous chloride and combinations thereof. Further, the article is dipped in the reducing bath for 1-3 minutes at room temperature, wherein the stannous chloride in the reducing bath is absorbed on the surface providing base for next activation bath step. The salt selected from a group of SnCl2 and other reducing salts such as Fe(II) ions, can be oxidized to Fe(III) ions, Mn(II) ions which can get oxidized to Mn(VII) ions and Ce(III) to Ce(IV), and such redox couples can be used in the sensitization step.

In example embodiments, the transition metal in the activating bath may be selected from a group comprising, notably silver, gold, copper, platinum, iridium, palladium, rhodium, ruthenium, technetium, molybdenum, niobium, zirconium, yttrium and combinations thereof. The chelating agent in the activating bath is selected from a group comprising EDTA (ethylenediaminetetraacetic acid), NTA (nitrilotriacetic acid), DTPA (diethylene-triaminepentaacetic acid), DS (N-(1,2-dicarboxyethyl)-D,L-aspartic acid (iminodisuccinic acid), DS (polyaspartic acid), EDDS (N,N'-ethylenediaminedisuccinic acid), GLDA (N,N-bis(carboxylmethyl)-L-glutamic acid) and MGDA (methylglycinediacetic acid) and combinations thereof. The bath formulations are optimized and differentiated with respect to the prior art. In the prior art calcium chloride is added to the silver bath, whereas example embodiment may use chelators. Besides, the silver baths of example embodiments are colorless and light insensitive as compared to the prior art. Also, example embodiments may be applied using spray, padding and industrially manufacturable processes. Further, the activating solution could be acidic or basic with pH in a range of 3-9, wherein the activation dip forms nucleating sites on the article, transforming into thin film depending upon the time of immersion, with coating thickness in range 1-10 microns.

In an example method the activated article is treated with an additional antimicrobial coating with antimicrobial metal by dipping it in antimicrobial bath for 5-10 minutes to homogeneously cover the entire article and/or dipping it in a solution of self-assembled monolayer molecule such as alkanethiols to impart an anti-tarnish ability and combinations thereof. Further, the additional antimicrobial coating bath comprises complexed and stabilized 1-50 g/liter CuSO4, 0.1-5 formaldehyde by wt % water, with pH of the additional antimicrobial bath in the range of 8-10 and thickness of the coating in additional antimicrobial coating bath is 1-100 microns. The metal in additional antimicrobial coating bath is selected from a group comprising silver, zinc, copper, gold and combinations thereof but not limited to. Further, the treatment in antimicrobial coating bath is for 5-15 minutes depending upon the thickness of the antimicrobial coating required for the composites. Besides, the rinsing steps are carried out between each of the individual treatment steps and the rinse water may be distilled water, but tap water is also applicable, with the temperature of the rinse water between room temperature to about 30° C.

In another example embodiment a method includes drying by natural drying or in a stream of hot air. Further, the coatings in the pretreatment and metallization steps are performed by dipping, spraying, rolling, brushing, dripping, pouring, curtain coating, and combinations thereof.

Another example embodiment discloses a method wherein an additional etching step may be added as a pretreatment step for coating the hard materials selected from a group of ceramic, glass and engineering plastic composites. Further, mild HF, NH4F and other fluorine containing etchants may be added in the etching baths for glassy and ceramic type of substrates. The involvement of etching steps may be minimized in example embodiments. A simple dip in sulphuric acid or persulphate type of formulations suffices for the harder to coat materials.

Another example embodiment discloses a cost-efficient process and since there is no need for hexavalent chrome type of materials is a disinfectant/less-hazardous, so wastewater generated is also nontoxic to the environment. The room-temperature method for electroless metallization of non-conductive substrates is pure surface dependent chemistry and free of any pretreatment preparation or surface conditioning.

EXAMPLES

Example 1

Antimicrobial electroless plating for plastics: The article was plated with the stannous chloride/HCl bath followed by a bath prepared using silver salt, chelating agent and sodium hydroxide salt (scheme 1). The results showed good antimicrobial ability on the plated article, with 99% reduction of *Staphylococcus aureus* and *Escherichia coli*. Some antimicrobial activity was seen on the control article due to cross contamination as the two pieces were stored together (Tables 1 & 2)

TABLE 1

| Antimicrobial activity of the article with the Test Bacteria: *Staphylococcus aureus* ATCC6538 Quantitative Assessment of Activity ISO 22196-2011 | | | | |
|---|---|---|---|---|
| Untreated Lab Control. Conc of Innoculum on untreated sample at 0 hour (B): 1.39 × 104 | | | | Log = 4.14 |
| Untreated Lab Control. Conc of Innoculum on untreated sample after 24 hour (B): 1.43 × 105 | | | | Log = 5.15 |
| Sample Identification | No. of Bacteria on treated sample (C) | Log of Bacteria on treated sample | Anti-microbial Activity (R) (Log B-C) | Microbial Kill (% Reduction) |
| Untreated | 3300 | 3.51 | 1.64 | 97.69 |
| Treated | 1430 | 3.15 | 2.00 | 99.00 |

TABLE 2

| Antimicrobial activity of the article with the Test Bacteria: *Escherichia coli* ATCC 8739 Quantitative Assessment of Activity ISO 22196-2011 | | | | |
|---|---|---|---|---|
| Untreated Lab Control. Conc of Innoculum on untreated sample at 0 hour (B): 2.7 × 104 | | | | Log = 4.43 |
| Untreated Lab Control. Conc of Innoculum on untreated sample after 24 hour (B): 1.59 × 105 | | | | Log = 5.20 |
| Sample Identification | No. of Bacteria on treated sample (C) | Log of Bacteria on treated sample | Anti-microbial Activity (R) (Log B-C) | Microbial Kill (% Reduction) |
| Untreated | 4400 | 3.64 | 1.56 | 97.23 |
| Treated | 1580 | 3.19 | 2.01 | 99.00 |

Example 2

Antimicrobial electroless plating on glass surfaces: The article was plated as per scheme 1 with the stannous chloride bath followed by a bath prepared using silver salt, chelating agent and sodium hydroxide salt, the results showed good antimicrobial ability on the plated article.

Example 3

Antimicrobial electroless plating on bandages: In this study the object was to coat wound-care bandages with alloys of copper to impart an antimicrobial surface on these to prevent the spread of infection in patients such as burn victims. Scheme 1 in FIG. 1 was used to prepare the cloths. The time of dipping and spraying was also optimized as shown in FIG. 3 where the specimens were dipped for a period of 3 min and 1 min in each bath. Even a 1-minute dip gave a satisfactory result. The detailed microbiological results are given below in Table 3. Test Treated Sample when compared with control sample showed 99.9999% antimicrobial activity against *Escherichia coli* when exposed for 10 minutes.

TABLE 3

| Time Kill study of the sample on *E. coli* using ASTM E-2315: Initial Cell suspension: 2.7 × 106 CFU/ml | | | | |
|---|---|---|---|---|
| Test Organism | Test Material | Contact Time | CFU/ml | % Reduction |
| *Escherichia coli* | Control sample | 10 min | 2.1 × 106 | NA |
| | Treated sample | | Nil | 99.9999% |

This novel methodology for coating non-conducting surfaces with antibacterial electroplating layers, besides making them anti corrosive, can kill bacteria, viruses and fungus that evolve on the surfaces of these articles, on contact due to the antimicrobial properties of transitions metals such as silver, copper, gold and zinc. The antimicrobial electroplated layer coating methodology can be used to treat non conducting surfaces such as plastic, glass and ceramics. The electroless plating methodology to impart antibacterial properties can be applied to textiles as well in making metallic fibers, which would have the lasting antimicrobial properties apart from interesting mechanical and electrical properties. This cost efficient and environmentally friendly methodology results in broad-spectrum antimicrobial (antibacterial, antiviral, antifungal) properties of copper-impregnated fibers and polyester products. This can be done using the methodology as depicted in FIG. 4 where the traditional padding process for textiles has been adapted to coat textiles, non-woven fabrics and sheets of plastic type industrially relevant materials with antimicrobial layers.

The electroless plating can be applied on the water filters as well, where antimicrobial coating on the water filters can revolutionize the future in water filtration units. Besides providing filtered water, this antimicrobial electroless plating of copper makes it anti-corrosive, thus, increasing the longevity of the product circumventing the issue of tarnishing. Coating of the copper metal can make it a cost-effective alternative to the regular filters. For example, most RO membranes are thin-film composites constructed with a polyamide layer atop a polyether sulfone porous layer. In conjunction with the permeate collection material the antimicrobial ability can be imparted by the current coatings. Further the polypropylene sediment filters in water filters are cartridges made from spun polypropylene usually pleated or threaded or plain cylindrical. These could be coated with the described electroless metal technology. Example embodiments may use all such filters that are used in the water and waste-water filtration industry and the anti-microbial capability will be an important and distinguishing characteristic.

Example 4

Antimicrobial electroless plating for air filters: The air filters made up of polypropylene plastic were coated with novel anti-microbial electroless plating technology of alloy copper to neutralize bacteria, fungus and viruses on contact as the air passes over the mesh using scheme 2. The treated filters were fitted in the air conditioners and air samples from different locations, before and after switching on the device with filters were collected. The microbiological analysis by the active air sampling as the air passes over the mesh was done and the Total Plate Count (TPC), which detects and quantitates total bacterial concentration in the sample after 24 h of incubation and Yeast and Mold Counts (YMC) used to detect and quantify the amount of fungal growth, was recorded as under. Air samples collected with Sample 1 filters after 2 hours of switching the device on showed 48.95% reduction in TPC and 85% reduction in the YMC as compared to the untreated filters (Table 4). Air samples collected with Sample 2 filters after 30 minutes of switching on the device showed 21.58% reduction in TPC and 45.45% reduction in YMC; whereas the air sample collected after 6 hours the device was on showed 55.5% % reduction in TPC and 77.27% reduction in YMC (Table 5).

TABLE 4

| Microbiological analysis of the antimicrobial activity of the Sample 1 | | | | | |
|---|---|---|---|---|---|
| | | Results-CFU/m3 | | % Reduction | |
| Sr. No. | Details | TPC (SCDA) | YMC (SDA) | TPC (SCDA) | YMC (SDA) |
| | Location No. 1 Regular filter | 96 | 600 | — | — |
| | Location No. 1 (Filter after Treatment-Device ON) | 49 | 90 | 48.95 | 85 |

TABLE 5

| Microbiological analysis of the antimicrobial activity of the Sample 2 | | | | | |
|---|---|---|---|---|---|
| | | Results-CFU/m3 | | | |
| Sr. No. | Details | TPC (SCDA) | YMC (SDA) | % Reduction TPC | % Reduction YMC |
| | Treated filter at time zero | 227 | 44 | — | — |
| | Treated filter after 30 min of device on | 178 | 24 | 21.58 | 45.45 |
| | Treated filter after 6 hrs. device on | 101 | 10 | 55.5 | 77.27 |

In accordance with advantages of example embodiments as compared with the existing systems, example embodiments provide a big change in the electroless plating technology in chemical processes industry. This is a low cost, easy to be deployed methodology that is manufacturable, for different types of articles. It is an effective alternative to nickel chromium plating and results in highly corrosion resistant, hard and less porous articles with anti-microbial coating. It may be an advantage that, all process steps can be carried out at room temperature (between about 20 and about 25° C.). This is a significant advantage in comparison to the methods known from the state of the art, as in the absence of additional devices for heating and temperature maintenance, energy for heating and maintaining temperature need not be exhausted. The prior art involves the use of several palladium and laborious sequential deposition techniques, whereas example embodiments may use only 2-3 steps in totality, making it a more efficient process.

It will be further appreciated that functions or structures of a plurality of components or steps may be combined into a single component or step, or the functions or structures of one-step or component may be split among plural steps or components. Example embodiments contemplate all of these combinations. Unless stated otherwise, dimensions and geometries of the various structures depicted herein are not intended to be restrictive, and other dimensions or geometries are possible. In addition, while a feature may have been described in the context of only one of the illustrated embodiments, such feature may be combined with one or more other features of other embodiments, for any given application. It will also be appreciated from the above that the fabrication of the unique structures herein and the operation thereof also constitute example methods. Example embodiments also encompass intermediate and end products resulting from the practice of the methods herein.

Some example embodiments and methods thus being described, it will be appreciated by one skilled in the art that examples may be varied through routine experimentation and without further inventive activity. For example, although liquid solutions are generated in some example systems, it is understood that other delivery forms including powders and tablets are useable with examples. Variations are not to be regarded as departure from the spirit and scope of the example embodiments, and all such modifications as would be obvious to one skilled in the art are intended to be included within the scope of the following claims.

The invention claimed is:

1. A method for electroless coating a non-conductive article, the method comprising:

providing the non-conductive article;

applying a reducing bath to the article for 1-3 minutes, wherein the bath includes reducing agents 1-5% wt and a pH maintaining buffer 0-1% wt in water, wherein the reducing agent includes stannous chloride;

water rinsing the article;

activating the rinsed article by applying an aqueous activating bath to the article for 1-3 minutes, wherein the aqueous activating bath includes silver 0.1-5% wt, a chelating agent 1-10% wt, and a pH maintaining agent in water to form a film coating of 1-10 micron thickness on the rinsed article;

water rinsing and drying the activated article, wherein the reducing bath, the aqueous activating bath, and the water of the rinsings are at room temperature; and treating the activated article with an antimicrobial coating containing antimicrobial metal by dipping the article in an antimicrobial bath including complexed and stabilized 1-50 g/liter $CuSO_4$ and 0.1-5% wt formaldehyde in water, and wherein a pH of the antimicrobial bath is 8-10.

2. The method of claim 1, wherein the article is nonconductive and is made from at least one of plastic, polymer, ceramic, composite materials, fabric, and natural fibers.

3. The method of claim 1, wherein the applying the reducing bath is executed until the reducing agents are absorbed on a surface of the article so as to provide an adherent surface for aiding the forming of the thin film, and wherein the reducing agents further include at least one of hypophosphite and formaldehyde.

4. The method of claim 1, wherein the transition metal further includes at least one of gold, copper, platinum, iridium, palladium, rhodium, ruthenium, technetium, molybdenum, niobium, zirconium, and yttrium.

5. The method of claim 1, wherein the chelating agent in the activating bath is at least one of ethylenediaminetetraacetic acid (EDTA), nitrilotriacetic acid (NTA), diethylene-triaminepentaacetic acid (DTPA), N-(1,2-dicarboxyethyl)-D (DS), L-aspartic acid, polyaspartic acid, N,N'-ethylenediaminedisuccinic acid (EDDS), N,N-bis (carboxylmethyl)-L-glutamic acid (GLDA), and methylglycinediacetic acid (MGDA).

6. The method of claim 1, wherein the aqueous activating bath has a pH in a range of 3-9.

7. The method of claim 1, wherein the aqueous activating bath forms nucleating sites on the article that transform into the thin film until the thin film has a thickness of 1-10 microns.

8. The method of claim 1, further comprising:

treating the activated article with an additional antimicrobial coating containing an additional antimicrobial metal by dipping the article in a solution of self-assembled monolayer molecules.

9. The method of claim 8, wherein the treating is executed until a thickness of the additional antimicrobial coating is 1-100 microns.

10. The method of claim 1, wherein the antimicrobial metal includes at least one of silver, zinc, titanium, cobalt, copper, and gold.

11. The method of claim 1, wherein the treating is executed for 1-15 minutes.

12. The method of claim 1, wherein drying includes at least one of unheated evaporation and flowing hot air over the article in a drying chamber having a temperature between 80-100° C.

13. The method of claim 1, wherein the applying the reducing bath and the activating include at least one of dipping, spraying, rolling, brushing, dripping, pouring, and curtain coating.

14. The method of claim 1, further comprising:

etching the article prior to the applying the reducing bath, wherein the article is a hard materials including at least one of ceramic, glass, and engineering plastic composite.

15. The method of claim 14, wherein the etching uses an etchant of at least one of hydrofluoric acid, persulfate, and ammonium bifluorite.

16. The method of claim 1, wherein the method metalizes the article for at least one of electronic shielding, EMI shielding, RF shielding electronic packaging, thermal management, electroplating, and coating of integrated circuits.

17. The method of claim 1, wherein the non-conductive article is a textile.

18. The method of claim 1, wherein the method does not include using a power source on the article or pre-treating or conditioning surface areas of the article.

19. The method of claim 1, wherein the article is homogenously covered over its entire surface with the antimicrobial coating.

* * * * *